US010478895B2

(12) United States Patent
Yang et al.

(10) Patent No.: US 10,478,895 B2
(45) **Date of Patent: *Nov. 19, 2019**

(54) POROUS ALUMINUM SINTERED COMPACT AND METHOD OF PRODUCING POROUS ALUMINUM SINTERED COMPACT

(71) Applicant: MITSUBISHI MATERIALS CORPORATION, Tokyo (JP)

(72) Inventors: Ji-Bin Yang, Kitamoto (JP); Koichi Kita, Kitamoto (JP); Toshihiko Saiwai, Kitamoto (JP); Koji Hoshino, Kitamoto (JP); Jun Katoh, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/302,374

(22) PCT Filed: May 18, 2015

(86) PCT No.: PCT/JP2015/064180

§ 371 (c)(1),
(2) Date: Oct. 6, 2016

(87) PCT Pub. No.: WO2015/174542

PCT Pub. Date: Nov. 19, 2015

(65) Prior Publication Data

US 2017/0028473 A1 Feb. 2, 2017

(30) Foreign Application Priority Data

May 16, 2014 (JP) ..... 2014-102778
May 14, 2015 (JP) ..... 2015-099293

(51) Int. Cl.
*B32B 5/18* (2006.01)
*B22F 3/11* (2006.01)
(Continued)

(52) U.S. Cl.
CPC ..... *B22F 3/1103* (2013.01); *B22F 1/0059* (2013.01); *B22F 1/02* (2013.01);
(Continued)

(58) Field of Classification Search
None
See application file for complete search history.

(56) References Cited

U.S. PATENT DOCUMENTS 3,301,671 A 1/1967 Storchheim
5,098,469 A * 3/1992 Rezhets ..... C22C 1/0433 419/32

(Continued)

FOREIGN PATENT DOCUMENTS

CA 1176490 A 10/1984
CN 1373233 A 10/2002

(Continued)

OTHER PUBLICATIONS

Merriam-Webster, "Definition of include", accessed Jan. 23, 2018, https://www.merriam-webster.com/dictionary/include.*

(Continued)

*Primary Examiner* — Seth Dumbris
(74) *Attorney, Agent, or Firm* — Locke Lord LLP; James E. Armstrong, IV; Nicholas J. DiCeglie, Jr.

(57) ABSTRACT

A high-quality porous aluminum sintered compact, which can be produced efficiently at a low cost; has an excellent dimensional accuracy with a low shrinkage ratio during sintering; and has sufficient strength, and a method of producing the porous aluminum sintered compact are provided. The porous aluminum sintered compact is the porous aluminum sintered compact that includes aluminum substrates sintered each other. The junction, in which the aluminum substrates are bonded each other, includes the Ti—Al compound and the eutectic element compound capable of eutectic reaction with Al. It is preferable that the pillar-shaped protrusions projecting toward the outside are formed on outer surfaces of the aluminum substrates, and the pillar-shaped protrusions include the junction.

9 Claims, 9 Drawing Sheets

(51) Int. Cl.

| | |
|---|---|
| ***B22F 1/02*** | (2006.01) |
| ***C22C 1/08*** | (2006.01) |
| ***C22C 21/00*** | (2006.01) |
| ***C22C 49/06*** | (2006.01) |
| ***B22F 1/00*** | (2006.01) |
| ***B22F 9/04*** | (2006.01) |
| ***C22C 1/04*** | (2006.01) |
| ***C22C 21/06*** | (2006.01) |
| ***C22C 32/00*** | (2006.01) |

(52) U.S. Cl.

CPC ..... *B22F 1/025* (2013.01); *B22F 3/11* (2013.01); *B22F 9/04* (2013.01); *C22C 1/0416* (2013.01); *C22C 1/08* (2013.01); *C22C 21/00* (2013.01); *C22C 21/06* (2013.01); *C22C 32/0089* (2013.01); *C22C 49/06* (2013.01); *B22F 1/004* (2013.01); *B22F 3/1118* (2013.01); *B22F 2301/052* (2013.01); *B22F 2301/058* (2013.01); *B22F 2301/15* (2013.01); *B22F 2301/205* (2013.01); *B22F 2302/45* (2013.01); *B22F 2998/10* (2013.01); *Y10T 428/12479* (2015.01)

(56) References Cited

U.S. PATENT DOCUMENTS

| | | | | |
|---|---|---|---|---|
| 5,597,665 | A | 1/1997 | Harada et al. | |
| 5,788,737 | A | 8/1998 | Wakiyama et al. | |
| 2009/0165651 | A1 | 7/2009 | Burgess et al. | |
| 2012/0094142 | A1 | 4/2012 | Hoshino et al. | |
| 2013/0305673 | A1 * | 11/2013 | Zeller ..... | B01D 39/2034 55/523 |

FOREIGN PATENT DOCUMENTS

| | | | | |
|---|---|---|---|---|
| CN | 102162052 | A | 8/2011 | |
| CN | 102365143 | A | 2/2012 | |
| CN | 102438778 | A | 5/2012 | |
| CN | 102458725 | A | 5/2012 | |
| CN | 102778418 | A | 11/2012 | |
| CN | 103667762 | A | 3/2014 | |
| EP | 1402978 | A1 | 3/2004 | |
| EP | 2939762 | A1 | 11/2015 | |
| EP | 3144082 | A1 | 3/2017 | |
| EP | 3150305 | A1 | 4/2017 | |
| EP | 3165864 | A1 | 5/2017 | |
| EP | 3213839 | A1 | 9/2017 | |
| JP | 48-037488 | A | 6/1973 | |
| JP | 56-077301 | A | 6/1981 | |
| JP | 56-149363 | A | 11/1981 | |
| JP | 61-048566 | B2 | 10/1986 | |
| JP | H03-110045 | | 5/1991 | |
| JP | 06-330215 | A1 | 11/1994 | |
| JP | 08-325661 | A | 12/1996 | |
| JP | 08-325662 | A | 12/1996 | |
| JP | 2006-028616 | A | 2/2006 | |
| JP | 2008-020864 | A | 1/2008 | |
| JP | 4303649 | B2 | 7/2009 | |
| JP | 2009-228025 | A | 10/2009 | |
| JP | 2009-256788 | A | 11/2009 | |
| JP | 2010-500469 | A | 1/2010 | |
| JP | 2010-116623 | A | 5/2010 | |
| JP | 2010-255089 | A | 11/2010 | |
| JP | 2010-280951 | A | 12/2010 | |
| JP | 2011-023430 | A | 2/2011 | |
| JP | 2011-049023 | A | 3/2011 | |
| JP | 2011049023 | * | 3/2011 | ..... H01M 4/80 |
| JP | 2011-077269 | A | 4/2011 | |
| JP | 2011-214049 | A | 10/2011 | |
| JP | 2011-253645 | A | 12/2011 | |
| JP | 2012-119465 | A | 6/2012 | |
| JP | 2014-025148 | A | 2/2014 | |
| JP | 2014-031585 | A | 2/2014 | |
| JP | 2014-141733 | A | 8/2014 | |
| JP | 2014-194074 | A | 10/2014 | |
| JP | 2014-194075 | A | 10/2014 | |
| WO | 2008/017111 | A1 | 2/2008 | |
| WO | 2010/116679 | A1 | 10/2010 | |
| WO | 2014/133077 | A1 | 9/2014 | |
| WO | 2014/133079 | A1 | 9/2014 | |

OTHER PUBLICATIONS

Office Action dated Apr. 6, 2017, issued for the Chinese patent application No. 201580015338.7 and English translation thereof.
International Search Report dated Jun. 30, 2015, issued for PCT/JP2015/064180 and English tarnslation thereof.
Office Action dated Mar. 2, 2018, issued for the Chinese patent application No. 2015800153381 and English translation thereof.
Search Report dated Dec. 15, 2017, issued for the European patent application No. 157919853.
Office Action dated Dec. 11, 2018, issued for the Japanese patent application No. 2015-099293 and English translation thereof.
Office Action dated Sep. 3, 2018, issued for the Chinese patent application No. 201580015338.7 and a partial English translation of the search report.
International Search Report dated Dec. 8, 2015, issued for PCT/JP2015/080358 and English Translation thereof.
Office Action dated Jul. 18, 2018, issued for the Chinese Patent Application No. 201580058206.2 and a partial translation of the search report.
Search Report dated Mar. 22, 2018, issued for the European Patent Application No. 15855571.4.
International Search Report dated Jun. 30, 2015, issued for PCT/JP2015/064179 and English Translation thereof.
Office Action dated May 25, 2017, issued for the Chinese patent application No. 201580013707.9 and English translation thereof.
Search Report dated Dec. 4, 2017, issued for the European patent application No. 15792389.7.
Peisheng Liu, "Introduction to Cellular Materials" Beijing: Tsinghua University Press, Sep. 30, 2004, pp. 138-140 and English translation thereof.
Decision of Rejection dated Sep. 11, 2018, issued for the Chinese patent application No. 201580013707.9 and a partial English translation of the search report.
Office Action dated Nov. 27, 2018, issued for the Japanese patent application No. 2015-099292 and English translation thereof.
English Translation of JPH06330215, as in related U.S. Appl. No. 15/302,374.
Final Office Action issued in co-pending U.S. Appl. No. 15/306,388, dated Sep. 12, 2019.

* cited by examiner

POROUS ALUMINUM SINTERED COMPACT AND METHOD OF PRODUCING POROUS ALUMINUM SINTERED COMPACT

TECHNICAL FIELD

The present invention relates to a porous aluminum sintered compact, in which aluminum substrates are sintered each other, and a method of producing a porous aluminum sintered compact.

BACKGROUND ART

The above-described porous aluminum sintered compact is used as electrodes and current collectors in various batteries; parts of heat exchangers; sound deadening parts; filters; shock-absorbing parts; and the like, for example.

Conventionally, these porous aluminum sintered compacts are produced by methods disclosed in Patent Literatures 1 to 5 (PTLs 1 to 5), for example.

In PTL 1, a porous aluminum sintered compact is produced as explained below. First, a mixture formed by mixing an aluminum powder; paraffin wax grains; and a binder, is shaped into a sheet-shaped form and then, subjected to natural drying. Then, the wax grains are removed by dipping the dried sheet in an organic solvent. Then, the sheet is subjected to drying, defatting, and sintering to obtain the porous aluminum sintered compact.

In PTLs 2-4, porous aluminum sintered compacts are produced by forming viscous compositions by mixing aluminum powders, sintering additives including titanium, binders, plasticizers, and organic solvents; foaming after shaping the viscous compositions; and then heat-sintering under a non-oxidizing atmosphere.

In PTL 5, a porous aluminum sintered compact is produced by mixing a base powder made of aluminum, an Al alloy powder including a eutectic element for forming bridging, and the like; and heat-sintering the obtained mixture under a hydrogen atmosphere or in a mixed atmosphere of hydrogen and nitrogen. The porous aluminum sintered compact has a structure in which grains of the base powder made of aluminum are connected each other by bridge parts made of a hypereutectic organization.

CITATION LIST

Patent Literature

PTL 1: Japanese Unexamined Patent Application, First Publication No. 2009-256788 (A)

PTL 2: Japanese Unexamined Patent Application, First Publication No. 2010-280951 (A)

PTL 3: Japanese Unexamined Patent Application, First Publication No. 2011-023430 (A)

PTL 4: Japanese Unexamined Patent Application, First Publication No. 2011-077269 (A)

PTL 5: Japanese Unexamined Patent Application, First Publication No. H08-325661 (A)

SUMMARY OF INVENTION

Technical Problem

In the porous aluminum sintered compact and the method of producing the porous aluminum sintered compact described in PTL 1, there is a problem that obtaining one with a high porosity is hard. In addition, there are problems that bonding of aluminum substrates each other is inhibited by strong oxide films formed on the surfaces of the aluminum substrates in the case where the aluminum substrates are sintered each other; and a porous aluminum sintered compact with sufficient strength cannot be obtained.

In the porous aluminum sintered compacts and the methods of producing the porous aluminum sintered compact described in PTLs 2-4, there is a problem that the porous aluminum sintered compacts cannot be produced efficiently since the viscous compositions are subjected to shaping and foaming. In addition, there are problems that it takes a long time for the binder removal process since the viscous compositions contain large amounts of binders; the shrinkage ratios of the compacts increase during sintering; and a porous aluminum sintered compact having excellent dimensional accuracy cannot be obtained.

In addition, in the porous aluminum sintered compact and the method of producing the porous aluminum sintered compact described in PTL 5, the porous aluminum sintered compact has the structure in which grains of the base powder made of aluminum are connected each other by bridge parts made of a hypereutectic organization. In this bridge part, the low-melting temperature Al alloy powder having a eutectic composition is melted and a liquid phase is formed; and the bridge part is formed by this liquid phase being solidified between grains of the base powder. Therefore, it is hard to obtain one with high porosity.

In addition, in the porous aluminum sintered compacts described in PTLs 1-5, strength is not sufficient; and they are prone to be broken. Because of this, they have to be treated with special cautious measures during transportation and machining. Particularly, in a porous aluminum sintered compact with high porosity, there is a tendency that strength is further reduced.

The present invention is made under the circumstances explained above. The purpose of the present invention is to provide a high-quality porous aluminum sintered compact, which can be produced efficiently at a low cost; has an excellent dimensional accuracy with a low shrinkage ratio during sintering; and has sufficient strength, and a method of producing a porous aluminum sintered compact.

Solution to Problem

In order to achieve the purpose by solving the above-mentioned technical problems, the present invention has aspects explained below. An aspect of the present invention is a porous aluminum sintered compact including a plurality of aluminum substrates sintered each other, wherein a junction, in which the plurality of aluminum substrates are bonded each other, includes a Ti—Al compound and a eutectic element compound including a eutectic element capable of eutectic reaction with Al.

According to the porous aluminum sintered compact configured as described above, which is an aspect of the present invention, diffusion migration of aluminum is suppressed since the junction of the aluminum substrates includes the Ti—Al compound. Therefore, voids can be maintained between the aluminum substrate; and a porous aluminum sintered compact having high porosity can be obtained.

In addition, the junction, in which the aluminum substrates are bonded each other, includes the eutectic element compound including a eutectic element capable of eutectic reaction with Al. It is understood that this eutectic element compound is formed by reaction between aluminum in the aluminum substrates and the eutectic element. By having the eutectic element interposing therebetween in this manner, locations having a lowered melting point appear locally in the aluminum substrates. In the locations having the lowered melting point, thick junctions between the aluminum substrates are likely to be formed. As a result, strength of the porous aluminum sintered compact can be improved.

In the porous aluminum sintered compact, which is an aspect of the present invention, a plurality of pillar-shaped protrusions projecting toward an outside may be formed on outer surfaces of the aluminum substrates, and the pillar-shaped protrusions may include the junction.

In this case, the porous aluminum sintered compact has a structure in which the aluminum substrates are bonded each other through the pillar-shaped protrusions formed on the outer surfaces of the aluminum substrates. Thus, a porous aluminum sintered compact having high porosity can be obtained without performing the step of foaming or the like separately. Therefore, the porous aluminum sintered compact can be produced efficiently at low cost.

In addition, the porous aluminum sintered compact, which has an excellent dimensional accuracy with a low shrinkage ratio during sintering and sufficient strength, can be obtained, since there is a less amount of binders between the aluminum substrates unlike the viscous compositions.

Furthermore, thick pillar-shaped protrusions are likely to be formed by having the interposing eutectic element to improve strength of the porous aluminum sintered compact significantly.

In the porous aluminum sintered compact, which is an aspect of the present invention, the aluminum substrates may be made of any one of or both of aluminum fibers and an aluminum powder.

In the case where the aluminum fibers are used as the aluminum substrates, the voids are likely to be held during bonding of the aluminum fibers through the pillar-shaped protrusions; and porosity tends to be increased. Accordingly, the porosity of the porous aluminum sintered compact can be controlled by: using the aluminum fibers and the aluminum powder as the aluminum substrates; and adjusting their mixing ratios.

In the porous aluminum sintered compact, which is an aspect of the present invention, a porosity of the porous aluminum sintered compact may be in a range of 30% or more and 90% or less.

In the porous aluminum sintered compact configures as described above, it is possible to provide a porous aluminum sintered compact having an optimal porosity depending on the application since the porosity is controlled in the range of 30% or more and 90% or less.

Other aspect of the present invention is a method of producing a porous aluminum sintered material including a plurality of aluminum substrates sintered each other, the method including the steps of: forming an aluminum raw material for sintering by adhering a titanium powder, which is made of any one of or both of a titanium metal powder and a titanium hydride powder, and a eutectic element powder made of a eutectic element capable of eutectic reaction with Al on outer surfaces of the aluminum substrates; spreading the aluminum raw material for sintering on a holder; and sintering the aluminum raw material held on the holder by heating, wherein the plurality of the aluminum substrates are bonded through a junction including a Ti—Al compound and a eutectic element compound including the eutectic element capable of eutectic reaction with Al.

In the method of producing a porous aluminum sintered compact configured as described above, the porous aluminum sintered compact is produced by sintering the aluminum raw material for sintering in which a titanium powder, which is made of any one of or both of a titanium metal powder and a titanium hydride powder, and a eutectic element powder made of a eutectic element capable of eutectic reaction with Al are adhered on the outer surfaces of the aluminum substrates.

In the case where the above-described aluminum raw material for sintering is heated to near the melting point of the aluminum substrates in the step of sintering, the aluminum substrates are melted. However, oxide films are formed on the surfaces of the aluminum substrates; and the melted aluminum is held by the oxide films. As a result, the shapes of the aluminum substrates are maintained. In addition, diffusion migration of aluminum is suppressed since the aluminum substrates are bonded each other through the junctions including the Ti—Al compounds. Accordingly, voids between the aluminum substrates can be maintained; and a porous aluminum sintered compact having high porosity can be obtained.

Moreover, the melting point of the aluminum substrates is lowered locally on the part with the interposing grain of the eutectic element powder, since the grain of the eutectic element powder made of the eutectic element capable of eutectic reaction with Al is adhered between the aluminum substrates on the surfaces of the aluminum substrates. Accordingly, the pressure in spouting out of the melted aluminum in the oxide film is reduced due to destruction of the oxide film by reacting with titanium; and thick junctions between the aluminum substrates are likely to be formed. As a result, strength of the porous aluminum sintered compact can be improved.

In the method of producing a porous aluminum sintered compact, which is other aspect of the present invention, the junction may be formed on a plurality of pillar-shaped protrusions projecting toward an outside from outer surfaces of the aluminum substrates.

In the part where the titanium powder is adhered among the outer surfaces of the aluminum substrates, the oxide files are destroyed by the reaction with titanium; the melted aluminum inside spouts out; and the spouted out melted aluminum forms a high-melting point compound by reacting with titanium to be solidified. Because of this, the pillar-shaped protrusions projecting toward the outside are formed on the outer surfaces of the aluminum substrates.

Then, though the pillar-shaped protrusions formed on the outer surfaces of the aluminum substrates, the aluminum substrates are bonded each other. Thus, a porous aluminum sintered compact having high porosity can be obtained without performing the step of foaming or the like separately.

Furthermore, the porous aluminum sintered compact, which has an excellent dimensional accuracy with a low shrinkage ratio during sintering and sufficient strength, can be obtained, since there is a less amount of binders between the aluminum substrates unlike the viscous compositions.

In addition, filling up of the voids between the aluminum substrates by the melted aluminum can be prevented, since the melted aluminum is solidified by titanium. Thus, a porous aluminum sintered compact having high porosity can be obtained.

In the method of producing a porous aluminum sintered compact, which is other aspect of the present invention, a nickel powder may be used as the eutectic element powder in the step of forming an aluminum raw material for sintering; a content amount of the titanium powder in the aluminum raw material for sintering may be set in a range of 0.01 mass % or more and 20 mass % or less; and a content amount of the nickel powder in the aluminum raw material for sintering may be set in a range of 0.01 mass % or more and 5 mass % or less.

In this case, since the content amount of the titanium powder is set to 0.01 mass % or more and the content amount of the nickel powder as the eutectic element powder is set to 0.01 mass % or more, the aluminum substrates can be bonded each other reliably; and a porous aluminum sintered compact having sufficient strength can be obtained. In addition, since the content amount of the titanium powder is set to 20 mass % or less, and the content amount of the nickel powder as the eutectic element powder is set to 5 mass % or less, the filling up of the voids between the aluminum substrates by the melted aluminum can be prevented; and a porous aluminum sintered compact having high porosity can be obtained.

In the method of producing a porous aluminum sintered compact, which is other aspect of the present invention, a magnesium powder may be used as the eutectic element powder in the step of forming an aluminum raw material for sintering; a content amount of the titanium powder in the aluminum raw material for sintering may be set in a range of 0.01 mass % or more and 20 mass % or less; and a content amount of the magnesium powder in the aluminum raw material for sintering may be set in a range of 0.01 mass % or more and 5 mass % or less.

In this case, since the content amount of the titanium powder is set to 0.01 mass % or more and the content amount of the magnesium powder as the eutectic element powder is set to 0.01 mass % or more, the aluminum substrates can be bonded each other reliably; and a porous aluminum sintered compact having sufficient strength can be obtained. In addition, since the content amount of the titanium powder is set to 20 mass % or less, and the content amount of the magnesium powder as the eutectic element powder is set to 5 mass % or less, the filling up of the voids between the aluminum substrates by the melted aluminum can be prevented; and a porous aluminum sintered compact having high porosity can be obtained.

In the method of producing a porous aluminum sintered compact, which is other aspect of the present invention, a copper powder may be used as the eutectic element powder in the step of forming an aluminum raw material for sintering; a content amount of the titanium powder in the aluminum raw material for sintering may be set in a range of 0.01 mass % or more and 20 mass % or less; and a content amount of the copper powder in the aluminum raw material for sintering may be set in a range of 0.01 mass % or more and 5 mass % or less.

In this case, since the content amount of the titanium powder is set to 0.01 mass % or more and the content amount of the copper powder as the eutectic element powder is set to 0.01 mass % or more, the aluminum substrates can be bonded each other reliably; and a porous aluminum sintered compact having sufficient strength can be obtained. In addition, since the content amount of the titanium powder is set to 20 mass % or less, and the content amount of the copper powder as the eutectic element powder is set to 5 mass % or less, the filling up of the voids between the aluminum substrates by the melted aluminum can be prevented; and a porous aluminum sintered compact having high porosity can be obtained.

In the method of producing a porous aluminum sintered compact, which is other aspect of the present invention, a silicon powder may be used as the eutectic element powder in the step of forming an aluminum raw material for sintering; a content amount of the titanium powder in the aluminum raw material for sintering may be set in a range of 0.01 mass % or more and 20 mass % or less; and a content amount of the silicon powder in the aluminum raw material for sintering may be set in a range of 0.01 mass % or more and 15 mass % or less.

In this case, since the content amount of the titanium powder is set to 0.01 mass % or more and the content amount of the silicon powder as the eutectic element powder is set to 0.01 mass % or more, the aluminum substrates can be bonded each other reliably; and a porous aluminum sintered compact having sufficient strength can be obtained. In addition, since the content amount of the titanium powder is set to 20 mass % or less, and the content amount of the silicon powder as the eutectic element powder is set to 15 mass % or less, the filling up of the voids between the aluminum substrates by the melted aluminum can be prevented; and a porous aluminum sintered compact having high porosity can be obtained.

In the method of producing a porous aluminum sintered compact, which is other aspect of the present invention, the step of forming an aluminum raw material for sintering may include the step of mixing the aluminum substrates; and the titanium powder and the eutectic element powder, in a presence of a binder; and drying a mixture obtained in the step of mixing.

In the method of producing a porous aluminum sintered compact as configured above, the step of forming an aluminum raw material for sintering includes the step of forming an aluminum raw material for sintering includes the steps of: mixing the aluminum substrates; and the titanium powder and the eutectic element powder, in a presence of a binder; and drying a mixture obtained in the step of mixing. Thus, the titanium powder and the eutectic element powder are dispersedly adhered on the surfaces of the aluminum substrates to produce the above-described aluminum raw material for sintering.

Advantageous Effects of Invention

According to the present invention, a high-quality porous aluminum sintered compact, which can be produced efficiently at a low cost; has an excellent dimensional accuracy with a low shrinkage ratio during sintering; and has sufficient strength, and a method of producing the porous aluminum sintered compact are provided.

DESCRIPTION OF EMBODIMENTS

The porous aluminum sintered compact 10, which is an embodiment of the present invention, is explained below in reference to the attached drawings.

Figure 1:
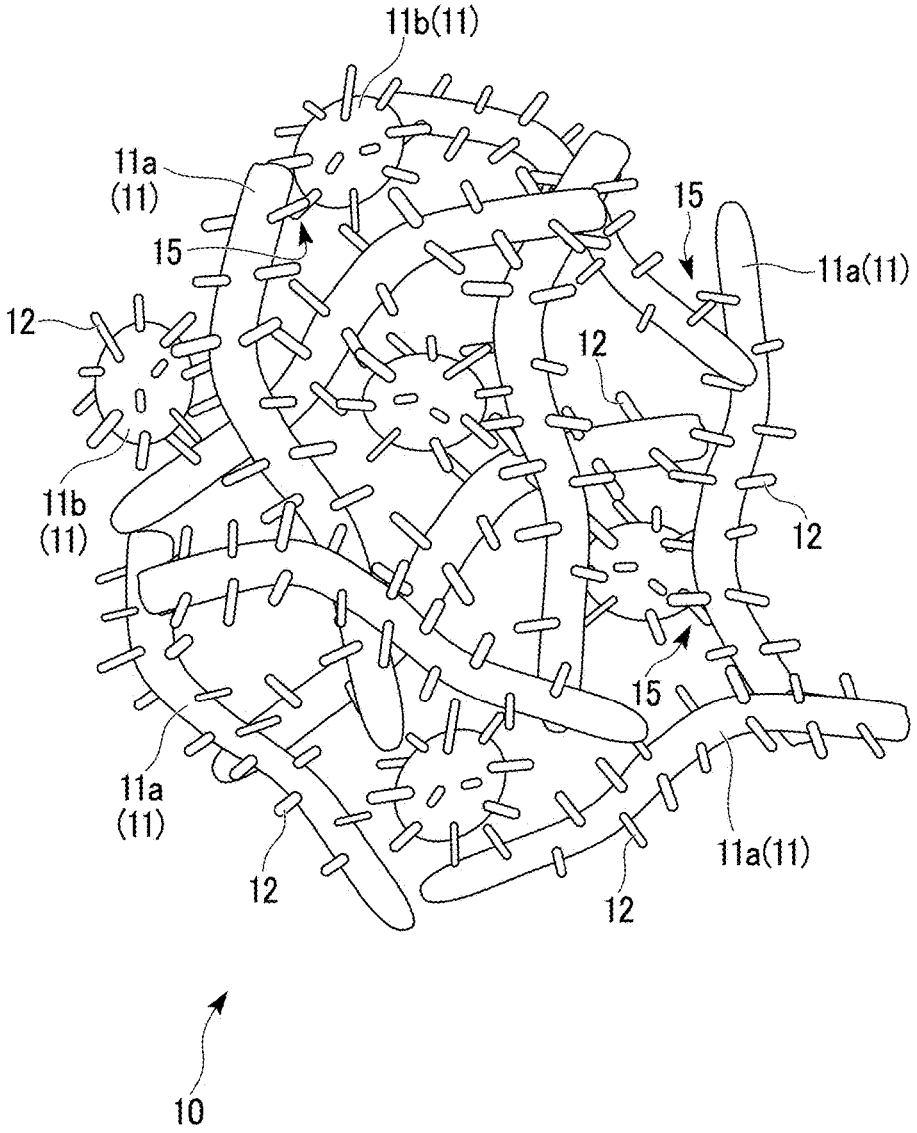
FIG. 1 is an enlarged schematic view of the porous aluminum sintered compact of an embodiment related to the present invention.

The porous aluminum sintered compact 10, which is an embodiment of the present invention, is shown in FIG. 1. As shown in FIG. 1, the porous aluminum sintered compact 10 of the present embodiment is what the aluminum substrates 11 are integrally combined by sintering; and the porosity of the porous aluminum sintered compact 10 is set to the range of 30% or more and 90% or less.

In the present embodiment, the aluminum fibers 11*a* and the aluminum powder 11*b* are used as the aluminum substrates 11 as shown in FIG. 1.

The porous aluminum sintered compact 10 has the structure, in which the pillar-shaped protrusions 12 projecting toward the outside are formed on the outer surfaces of the aluminum substrates 11 (the aluminum fibers 11*a* and the aluminum powder 11*b*); and the aluminum substrates 11 (the aluminum fibers 11*a* and the aluminum powder 11*b*) are bonded each other through the pillar-shaped protrusions 12. As shown in FIG. 1, the junctions 15 between the aluminum substrates 11, 11 include: a part in which the pillar-shaped protrusions 12, 12 are bonded each other; a part in which the pillar-shaped protrusion 12 and the side surface of the aluminum substrate 11 are bonded each other; and a part in which the side surfaces of the aluminum substrates 11, 11 are bonded each other.

Figure 2:
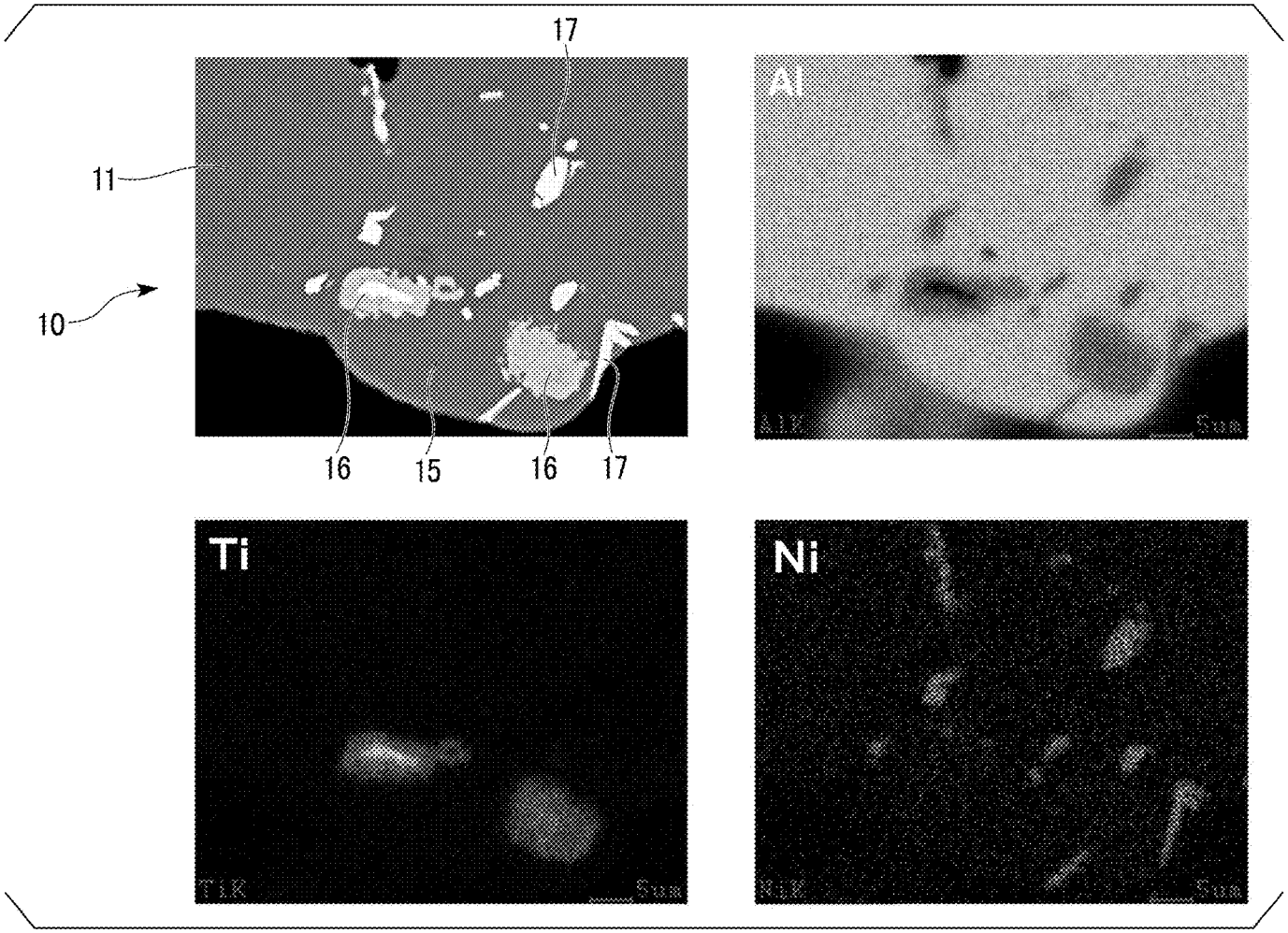
FIG. 2 is a diagram showing an SEM observation and composition analysis results of the junction between the aluminum substrates of the porous aluminum sintered compact shown in FIG. 1.

The junction 15 of the aluminum substrates 11, 11 bonded each other through the pillar-shaped protrusion 12, includes the Ti—Al compound 16 and the eutectic element compound 17 including a eutectic element capable of eutectic reaction with Al as shown FIG. 2.

The Ti—Al compound 16 is a compound of Ti and Al in the present embodiment as shown in the analysis results of FIG. 2. More specifically, it is $Al_3Ti$ intermetallic compound. In other words, the aluminum substrates 11, 11 are bonded each other in the part where the Ti—Al compound 16 exists in the present embodiment.

As the eutectic element capable of eutectic reaction with Al, Ag, Au, Ba, Be, Bi, Ca, Cd, Ce, Co, Cu, Fe, Ga, Gd, Ge, In, La, Li, Mg, Mn, Nd, Ni, Pd, Pt, Ru, Sb, Si, Sm, Sn, Sr, Te, Y, Zn, and the like are named, for example.

In the present embodiment, the eutectic element compound 17 includes Ni as the eutectic element as shown in the analysis results shown in FIG. 2.

Figure 8:
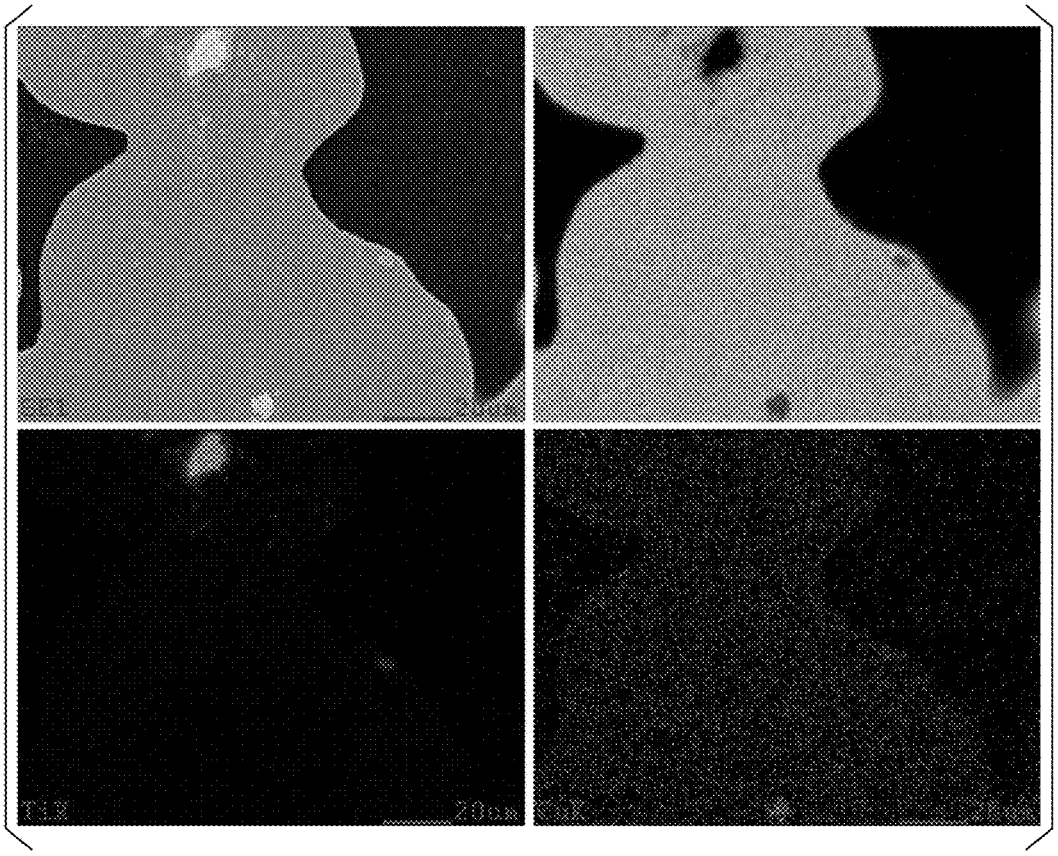
FIG. 8 is a figure showing SEM observation and composition analysis results of the junction between the aluminum substrates in the porous aluminum sintered compact shown in FIG. 1.

In addition, as shown in FIG. 8, Cu is solid soluted in Al; and the Ti—Al compound 16 and the eutectic element compound 17 capable of eutectic reaction with Al exist.

Figure 9:
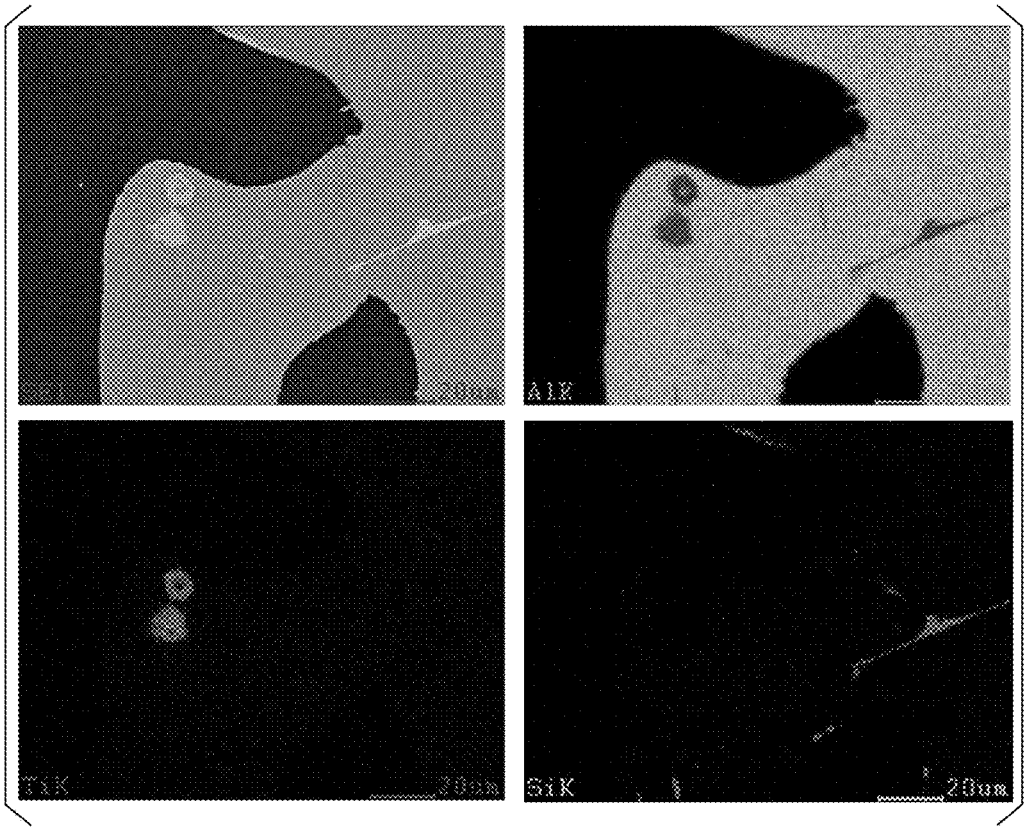
FIG. 9 is a figure showing SEM observation and composition analysis results of the junction between the aluminum substrates in the porous aluminum sintered compact shown in FIG. 1.

In addition, as shown in FIG. 9, Si is solid soluted in Al; and the Ti—Al compound 16 and the eutectic element compound 17 capable of eutectic reaction with Al exist.

Figure 4:
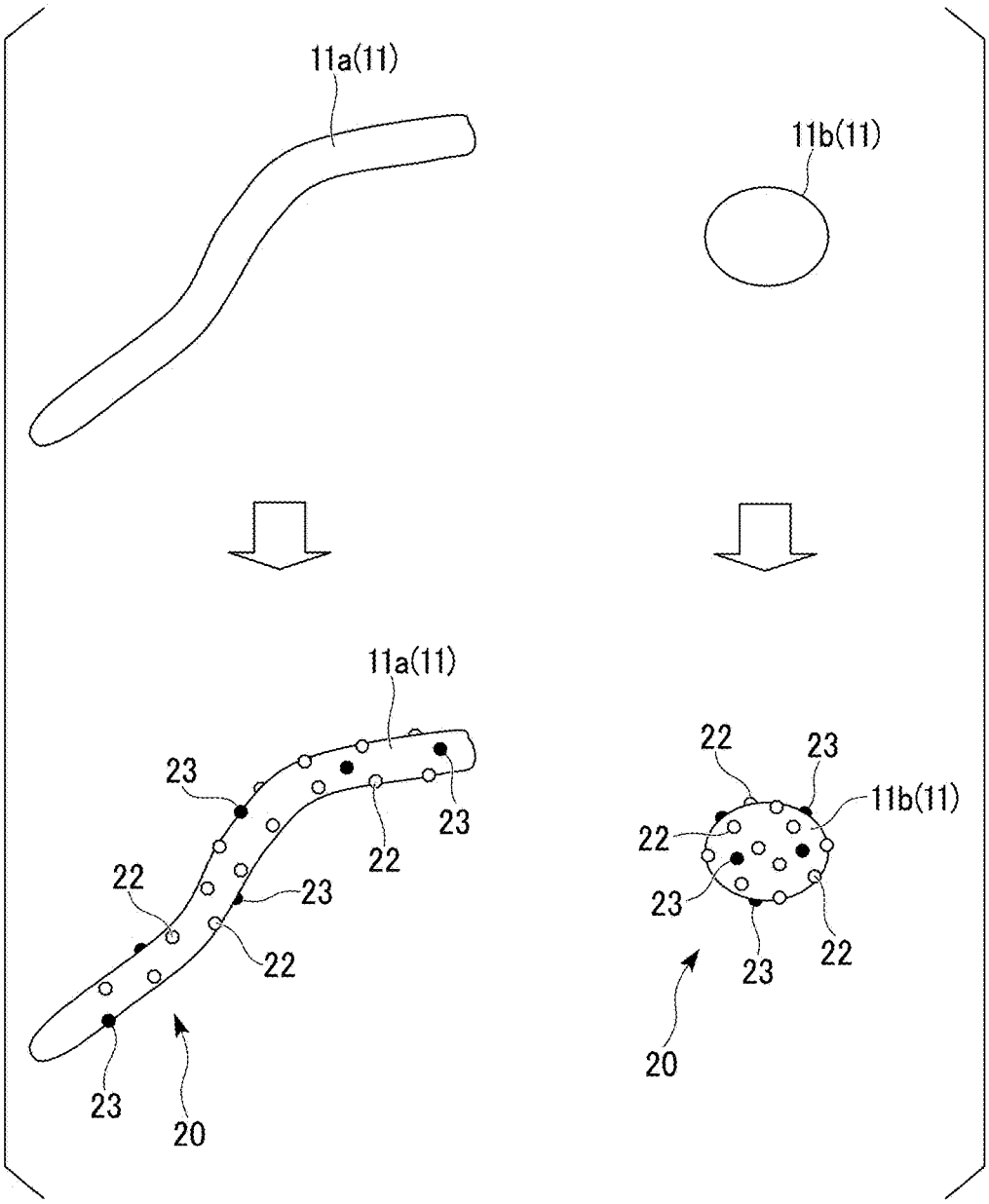
FIG. 4 is an explanatory diagram of the aluminum raw material for sintering in which the titanium powder and the eutectic element powder are adhered on the surfaces of the aluminum substrates.

Next, the aluminum raw material for sintering 20, which is the raw material of the porous aluminum sintered compact 10 of the present embodiment, is explained. The aluminum raw material for sintering 20 includes: the aluminum substrate 11; and the titanium powder grains 22 and the eutectic element powder grains 23 (the nickel powder grains, the magnesium powder grains, the copper powder grains, or the silicon powder grains), both of which are adhered on the outer surface of the aluminum substrate 11, as shown in FIG. 4. As the titanium powder grains 22, any one or both of the metal titanium powder grains and the titanium hydride powder grains can be used. As the eutectic element powder grains 23 (the nickel powder grains, the magnesium powder grains, the copper powder grains, or the silicon powder grains), the metal nickel powder grains; the metal magnesium powder grains; the metal copper powder grains; the metal silicon powder grains; and grains made of alloys thereof can be used.

The grain size of the titanium powder grains 22 is set to the range of 1 μm or more and 50 μm or less. Preferably, it is set to 5 μm or more and 30 μm or less. The titanium hydride powder grains can be set to a value finer than that of the metal titanium powder grains. Thus, in the case where the grain size of the titanium powder grains 22 adhered on the outer surface of the aluminum substrate 11 is set to a fine value, it is preferable that the titanium hydride powder grains are used.

Moreover, it is preferable that the distance between the titanium powder grains 22, 22 adhered on the outer surface of the aluminum substrate 11 is set to the range of 5 μm or more and 100 μm or less.

The grain size of the eutectic element powder grains 23 is set: to the range of 1 μm or more and 20 μm or less, preferably, 2 μm or more and 10 μm or less in the nickel powder grains; to the range of 20 μm or more and 500 μm or less, preferably, 20 μm or more and 100 μm or less in the magnesium powder grains; to the range of 5 μm or more and 500 μm or less, preferably, 20 μm or more and 100 μm or less in the copper powder grains; and to the range of 5 μm or more and 200 μm or less, preferably, 10 μm or more and 100 μm or less in the silicon powder grains.

As the aluminum substrate 11, the aluminum fibers 11*a* and the aluminum powder 11*b* are used as described above. As the aluminum powder 11*b*, an atomized powder can be used.

The fiber diameter of the aluminum fiber 11*a* is set to the range of 20 μm or more and 1000 μm or less. Preferably, it is set to the range of 50 μm or more and 500 μm or less. The fiber length of the aluminum fiber 11*a* is set to the range of 0.2 mm or more and 100 mm or less. Preferably, it is set to the range of 1 mm or more and 50 mm or less.

The aluminum fiber 11*a* is made of pure aluminum or an aluminum alloy, for example; and the ratio L/R of the length L to the fiber diameter R may be set to the range of 4 or more and 2500 or less. The aluminum fiber 11*a* can be obtained by the step of forming the aluminum raw material for sintering, in which any one or both of the silicon powder and the silicon alloy powder are adhered on its outer surface and the aluminum raw material for sintering is formed, for example. In the step of sintering, the aluminum raw material for sintering can be sintered at the temperature range of 575° C. to 665° C. under an inert gas atmosphere depending on the kind and additive amount of the added eutectic element grains.

In the case where the fiber diameter R of the aluminum fiber 11*a* is less than 20 μm, sufficient sintered strength might not be obtained due to too small junction area of the aluminum fibers. On the other hand, in the case where the fiber diameter R of the aluminum fiber 11*a* is more than 1000 μm, sufficient sintered strength might not be obtained due to lack of contact points of the aluminum fibers.

Because of the reasons described above, in the porous aluminum sintered compact 10 of the present embodiment, the fiber diameter R of the aluminum fiber 11*a* is set to the range of 20 μm or more and 500 μm or less. In the case where more improved sintered strength is needed, it is preferable that the fiber diameter of the aluminum fiber 11*a* is set to 50 μm or more; and the fiber diameter of the aluminum fiber 11*a* is set to 500 μm or less.

In the case where the ratio L/R of the length L of the aluminum fiber 11*a* to the fiber diameter R is less than 4, it becomes harder to keep the bulk density DP in a stacking arrangement at 50% of the true density DT of the aluminum fiber or less in the method of producing the porous aluminum sintered compact. Thus, obtaining the porous aluminum sintered compact 10 having high porosity could be difficult. On the other hand, in the case where the ratio L/R of the length L of the aluminum fiber 11*a* to the fiber diameter R is more than 2500, it becomes impossible to disperse the aluminum fibers 11*a* evenly. Thus, obtaining the porous aluminum sintered compact 10 having uniform porosity could be difficult.

Because of the reasons described above, in the porous aluminum sintered compact 10 of the present embodiment, the ratio L/R of the length L of the aluminum fiber 11*a* to the fiber diameter R is set to the range of 4 or more and 2500 or less. In the case where more improved porosity is needed, it is preferable that the ratio L/R of the length L to the fiber diameter R is set to 10 or more. In addition, in order to obtain the porous aluminum sintered compact 10 having more uniform porosity, it is preferable that the ratio L/R of the length L to the fiber diameter R is set to 500 or more.

The grain size of the aluminum powder 11*b* is set to the range of 5 μm or more and 500 μm or less. Preferably, it is set to the range of 20 μm or more and 200 μm or less.

In addition, the porosity can be controlled by adjusting the mixing rate of the aluminum fibers 11*a* and the aluminum powder 11*b*. More specifically, the porosity of the porous aluminum sintered compact can be improved by increasing the ratio of the aluminum fiber 11*a*. Because of this, it is preferable that the aluminum fibers Ha are used as the aluminum substrates 11. In the case where the aluminum powder 11*b* is mixed in, it is preferable that the ratio of the aluminum powder 11*b* in the aluminum substrates is set to 15 mass % or less.

In addition, as the aluminum substrates 11 (the aluminum fibers 11*a* and the aluminum powder 11*b*), the aluminum substrates made of the standard aluminum alloy may be used.

For example, the aluminum substrates made of the A3003 alloy Al-0.6 mass % Si-0.7 mass % Fe-0.1 mass % Cu-1.5 mass % Mn-0.1 mass % Zn alloy), the A5052 alloy (Al-0.25 mass % Si-0.40 mass % Fe-0.10 mass % Cu-0.10 mass % Mn-2.5 mass % Mg-0.2 mass % Cr-0.1 mass % Zn alloy) as defined in HS, and the like can be suitably used.

In addition, the composition of the aluminum substrates 11 is not limited to a specific single kind composition. It can be appropriately adjusted depending on the purpose, for example, like using the mixture of fibers made of the pure aluminum and the powder made of JIS A3003 alloy.

Figure 3:
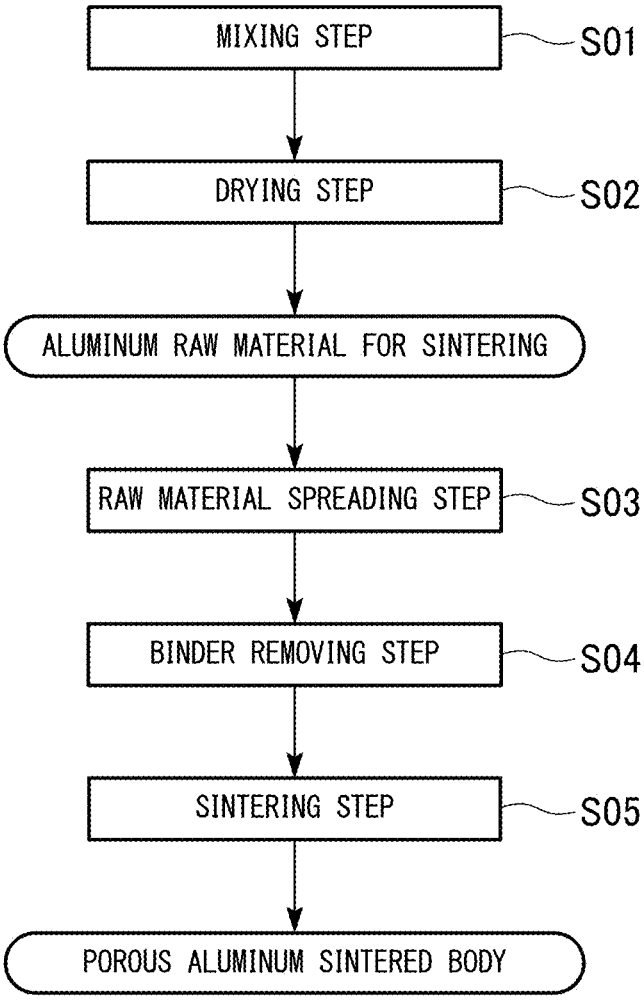
FIG. 3 is a flow diagram showing an example of the method of producing the porous aluminum sintered compact shown in FIG. 1.

Next, the method of producing the porous aluminum sintered compact 10 of the present embodiment is explained in reference to the flow diagram in FIG. 3 and the like.

First, the aluminum raw material for sintering 20, which is the raw material of the porous aluminum sintered compact 10 of the present embodiment, is produced as shown in FIG. 3.

The above-described aluminum substrates 11, the titanium powder, and the eutectic element powder (for example, the nickel powder grains, the magnesium powder grains, the copper powder grains, the silicon powder grains) are mixed at room temperature (the mixing step S01). At this time, the binder solution is sprayed on. As the binder, what is burned and decomposed during heating at 500° C. in the air is preferable. More specifically, using an acrylic resin or a cellulose-based polymer material is preferable. In addition, various solvents such as the water-based, alcohol-based, and organic-based solvents can be used as the solvent of the binder.

In the mixing step S01, the aluminum substrates 11, the titanium powder, and the eutectic element powder (the nickel powder) are mixed by various mixing machine, such as an automatic mortar, a pan type rolling granulator, a shaker mixer, a pot mill, a high-speed mixer, a V-shaped mixer, and the like, while they are fluidized.

Next, the mixture obtained in the mixing step S01 is dried (the drying step S02). By the mixing step S01 and the drying step S02, the titanium powder grains 22 and the eutectic element powder grain 23 (for example, the nickel powder grains, the magnesium powder grains, the copper powder grains, the silicon powder grains) are dispersedly adhered on the surfaces of the aluminum substrates 11 as shown in FIG. 4; and the aluminum raw material for sintering 20 in the present embodiment is produced. It is preferable that the titanium powder grains 22 are dispersed in such a way that the distance between the titanium powder grains 22, 22 adhered on the outer surfaces of the aluminum substrates 11 is set to the range of 5 μm or more and 100 μm or less.

Next, the porous aluminum sintered compact 10 is produced by using the aluminum raw material for sintering 20 obtained as described above.

Figure 5:
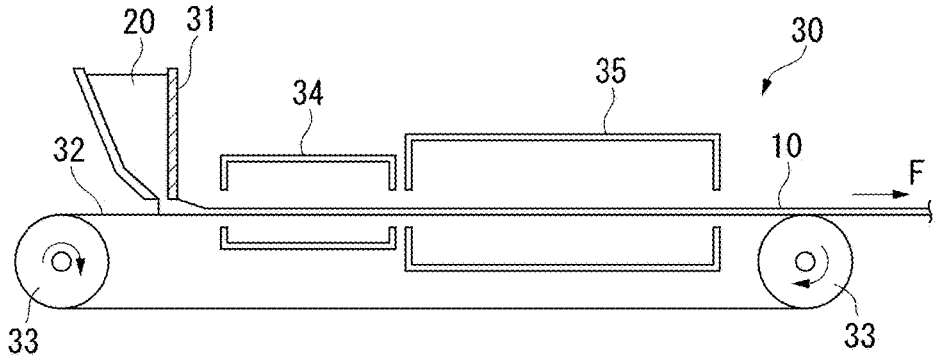
FIG. 5 is a schematic illustration of the continuous sintering apparatus for producing the porous aluminum sintered compact in a sheet shape.

In the present embodiment, the porous aluminum sintered compact 10 in the long sheet shape of: 300 mm of width; 1-5 mm of thickness; and 20 m of length, is produced, for example, by using the continuous sintering apparatus 30 shown in FIG. 5.

This continuous sintering apparatus 30 has: the raw material spreading device 31 spreading the aluminum raw material for sintering 20 evenly; the carbon sheet 32 holding the aluminum raw material for sintering 20 supplied from the raw material spreading device 31; the transport roller 33 driving the carbon sheet 32; the degreasing furnace 34 removing the binder by heating the aluminum raw material for sintering 20 transported with the carbon sheet 32; and the sintering furnace 35 sintering the binder-free aluminum raw material for sintering 20 by heating.

First, the aluminum raw material for sintering 20 is spread toward the upper surface of the carbon sheet 32 from the raw material spreading device 31 (the raw material spreading step S03).

The aluminum raw material for sintering 20 spread on the carbon sheet 32 spreads in the width direction of the carbon sheet 32 during moving toward the traveling direction F to be uniformed and formed into a sheet shape. At this time, load is not placed upon. Thus, voids are formed between the aluminum substrates 11 in the aluminum raw material for sintering 20.

Next, the aluminum raw material for sintering 20, which is shaped into a sheet-shape on the carbon sheet 32, is inserted in the degreasing furnace 34 with the carbon sheet 32; and the binder is removed by being heated at a predetermined temperature (the binder removing step S04).

In the binder removing step S04, the aluminum raw material for sintering 20 is maintained at 350° C. to 500° C. for 0.5 to 5 minutes in the air atmosphere; and the binder in the aluminum raw material for sintering 20 is removed. In the present embodiment, the binder is used only for adhering the titanium powder grains 22 and the eutectic element powder grains 23 (for example, the nickel powder grains, the magnesium powder grains, the copper powder grains, the silicon powder grains) on the outer surfaces of the aluminum substrates 11 as described above. Thus, the content amount of the binder is extremely low compared to the viscous compositions; and the binder can be removed sufficiently in a short time.

Next, the aluminum raw material for sintering 20 free of the binder is inserted in the sintering furnace 35 with the carbon sheet 32 and sintered by being heated at a predetermined temperature (the sintering step S05).

The sintering step S05 is performed by maintaining the aluminum raw material for sintering 20 at 575° C. to 665° C. for 0.5 to 60 minutes in an inert gas atmosphere depending on the kinds and amount of the added eutectic element grains.

In the sintering step S05, the aluminum substrates 11 in the aluminum raw material for sintering 20 are melted. Since the oxide films are formed on the surfaces of the aluminum substrates 11, the melted aluminum is held by the oxide film; and the shapes of the aluminum substrates 11 are maintained.

Figure 6:
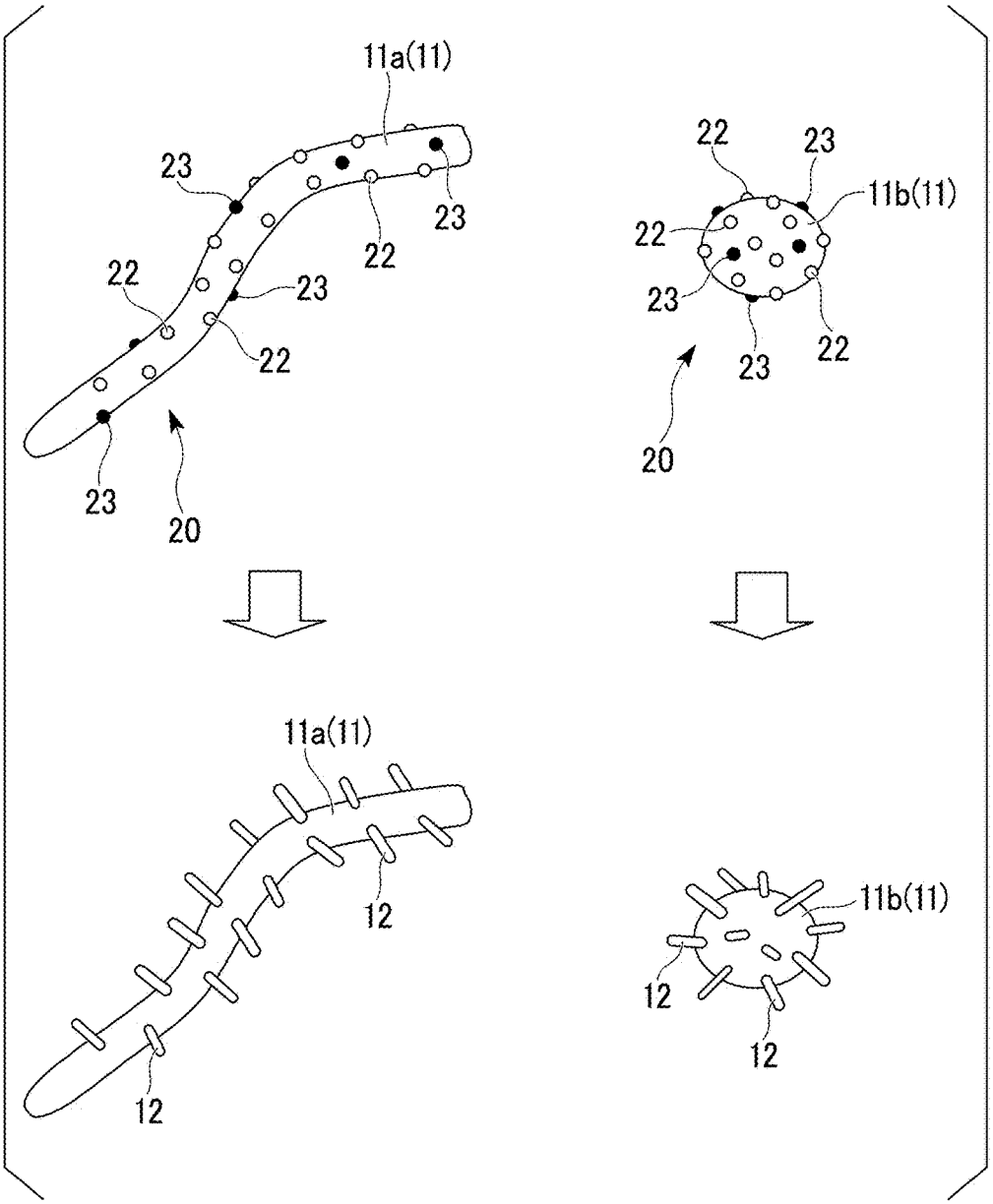
FIG. 6 is an explanatory diagram showing the state where the pillar-shaped protrusions are formed on the outer surfaces of the aluminum substrates in the step of sintering.

In the part where the titanium powder grains 22 are adhered among the outer surfaces of the aluminum substrates 11, the oxide files are destroyed by the reaction with titanium; and the melted aluminum inside spouts out. The spouted out melted aluminum forms a high-melting point compound by reacting with titanium to be solidified. Because of this, the pillar-shaped protrusions 12 projecting toward the outside are formed on the outer surfaces of the aluminum substrates 11 as shown in FIG. 6. On the tip of the pillar-shaped protrusion 12, the Ti—Al compound 16 exists. Growth of the pillar-shaped protrusion 12 is suppressed by the Ti—Al compound 16.

In the case where titanium hydride is used as the titanium powder grains 22, titanium hydride is decomposed near the temperature of 300° C. to 400° C.; and the produced titanium reacts with the oxide films on the surfaces of the aluminum substrates 11.

In addition, in the present embodiment, locations having a lowered melting point are formed locally to the aluminum substrates 11 by the eutectic element powder 23 (for example, the nickel powder grains, the magnesium powder grains, the copper powder grains, the silicon powder grains) adhered on the outer surfaces of the aluminum substrates 11. Therefore, the pillar-shaped protrusions 12 are formed reliably even in the relatively low temperature condition such as 575° C. to 665° C. depending on the kind and the additive amount of the added eutectic element grains. In addition, thick pillar-shaped protrusions 12 are formed since the melted aluminum spouts out in the state where the internal pressure in the aluminum substrates 11 is low At this time, the adjacent the aluminum substrates 11, 11 are bonded each other by being combined integrally in a molten state or being sintered in a solid state through the pillar-shaped protrusions 12 of each. Accordingly, the porous aluminum sintered compact 10, in which the aluminum substrates 11, 11 are bonded each other through the pillar-shaped protrusions 12 as shown in FIG. 1, is produced. In addition, the junction 15, in which the aluminum substrates 11, 11 are bonded each other through the pillar-shaped protrusion 12, includes the Ti—Al compound 16 ($Al_3Ti$ intermetallic compound in the present embodiment) and the eutectic element compound 17.

In the porous aluminum sintered compact 10 of the present embodiment configured as described above, the junction 15 of the aluminum substrates 11, 11 includes the Ti—Al compound 16. Thus, the oxide films formed on the surfaces of the aluminum substrates 11 are removed by the Ti—Al compound 16; and the aluminum substrates 11, 11 are bonded properly each other. Therefore, the high-quality porous aluminum sintered compact 10 having sufficient strength can be obtained.

In addition, since the growth of the pillar-shaped protrusions 12 is suppressed by the Ti—Al compound 16, spouting out of the melted aluminum into the voids between the aluminum substrates 11, 11 can be suppressed; and the porous aluminum sintered compact 10 having high porosity can be obtained.

Especially, $Al_3Ti$ exists as the Ti—Al compound 16 in the junction 15 of the aluminum substrates 11, 11 in the present embodiment. Thus, the oxide films formed on the surfaces of the aluminum substrates 11 are removed reliably; and the aluminum substrates 11, 11 are bonded properly each other. Therefore, strength of the porous aluminum sintered compact 10 can be ensured.

In addition, in the present embodiment, the junction 15 includes the eutectic element compound 17. Thus, there are locations having a lowered melting point locally in the aluminum substrates 11; the thick pillar-shaped protrusions 12 are likely to be formed; and strength of the porous aluminum sintered compact 10 can be improved.

In addition, the porous aluminum sintered compact 10 has the structure in which the aluminum substrates 11, 11 are bonded each other through the pillar-shaped protrusions 12 formed on the outer surfaces of the aluminum substrates 11. Thus, the porous aluminum sintered compact 10 having high porosity can be obtained without performing the step of foaming or the like separately. Therefore, the porous aluminum sintered compact 10 of the present embodiment can be produced efficiently at low cost.

Especially, the continuous sintering apparatus 30 shown in FIG. 5 is used in the present embodiment. Thus, the sheet-shaped porous aluminum sintered compact 10 can be produced continuously; and the production efficiency can be improved significantly.

Moreover, in the present embodiment, the content amount of the binder is extremely low compared to the viscous compositions. Thus, the binder removing step S04 can be performed in a short time. In addition, the shrinkage rate during sintering becomes about 1%, for example; and the porous aluminum sintered compact 10 having excellent dimensional accuracy can be obtained.

In addition, the aluminum fibers 11*a* and the aluminum powder 11*b* are used as the aluminum substrates 11 in the present embodiment. Thus, the porosity of the porous aluminum sintered compact 10 can be controlled by adjusting the mixing rates.

In addition, the porosity is set to the range of 30% or more and 90% or less in the porous aluminum sintered compact 10 of the present embodiment. Thus, it is possible to provide the porous aluminum sintered compact 10 having an optimal porosity depending on the application.

In addition, the content amount of the titanium powder grains 22 in the aluminum raw material for sintering 20 is set to 0.5 mass % or more and 20 mass % or less in the present embodiment. Thus, the pillar-shaped protrusions 12 can be formed with an appropriate distance therebetween on the outer surfaces of the aluminum substrates 11. Accordingly, the porous aluminum sintered compact 10 having sufficient strength and high porosity can be obtained.

In addition, the distance between the titanium powder grains 22, 22 each other adhered on the outer surfaces of the aluminum substrates 11 is set to the range of 5 μm or more and 100 μm or less in the present embodiment. Thus, the distance between the pillar-shaped protrusions 12 is set appropriately. Accordingly, the porous aluminum sintered compact 10 having sufficient strength and high porosity can be obtained.

In addition, the content amount of the eutectic element powder grains 23 in the aluminum raw material for sintering 20 is set: to 0.01 mass % or more and 5 mass % or less in the nickel powder grains; to 0.01 mass % or more and 5 mass % or less in the magnesium powder grains; to 0.01 mass % or more and 5 mass % or less in the copper powder grains; and to 0.01 mass % or more and 15 mass % or less in the silicon powder grains. Thus, locations with a lower melting point can be formed locally in the aluminum substrates 11 with an appropriate distance therebetween; and excessive overflow of the melted aluminum can be suppressed. Accordingly, the porous aluminum sintered compact 10 having sufficient strength and high porosity can be obtained.

In addition, the pillar-shaped protrusions 12 are formed reliably even in the relatively low temperature condition, such as 575° C. to 665° C., depending on the kind and the additive amount of the added eutectic element grains; and the temperature condition of the step of sintering can be set at a lower temperature.

In addition, the fiber diameter of the aluminum fiber 11*a*, which is the aluminum substrate 11, is set to the range of 20 μm or more and 1000 μm or less; and the grain size of the aluminum powder 11*b* is set to the range of 5 μm or more and 500 μm or less in the present embodiment. In addition, the grain size of the titanium powder grains 22 is set to the range of 1 μm or more and 50 μm or less; and the grain size of the eutectic element powder grains 23 is set: to the range of 1 μm or more and 20 μm or less in the nickel powder grains; to the range of 20 μm or more and 500 μm or less in the magnesium powder grains; to the range of 5 μm or more and 500 μm or less in the copper powder grains; and to the range of 5 μm or more and 200 μm or less in the silicon powder grains. Therefore, the titanium powder grains 22 and the eutectic element powder grains 23 (the nickel powder grains) are dispersedly adhered on the outer surfaces of the aluminum substrates 11 (the aluminum fibers 11*a* and the aluminum powder 11*b*) reliably.

In addition, the aluminum fibers 11*a* and the aluminum powder 11*b* are used as the aluminum substrates 11; and the ratio of the aluminum powder 11*b* relative to the aluminum substrates 11 is set to 15 mass % or less in the present embodiment. Thus, the porous aluminum sintered compact 10 with high porosity can be obtained.

Embodiments of the present invention are explained above. However, the present invention is not particularly limited by the description of the embodiments; and the present invention can be modified as need in the range that does not depart from the technical concept of the present invention as defined in the scope of the present invention.

For example, it is explained that the porous aluminum sintered compact is continuously produced by using the continuous sintering apparatus shown in FIG. 5. However, the present invention is not limited by the description, and the porous aluminum sintered compact may be produced by using other producing apparatus In addition, the sheet-shaped porous aluminum sintered compacts are explained in the present embodiment. However, the present invention is not particularly limited by the description, and it may be the bulk-shaped porous aluminum sintered compact produced by the production process shown in FIG. 7, for example.

Figure 7:
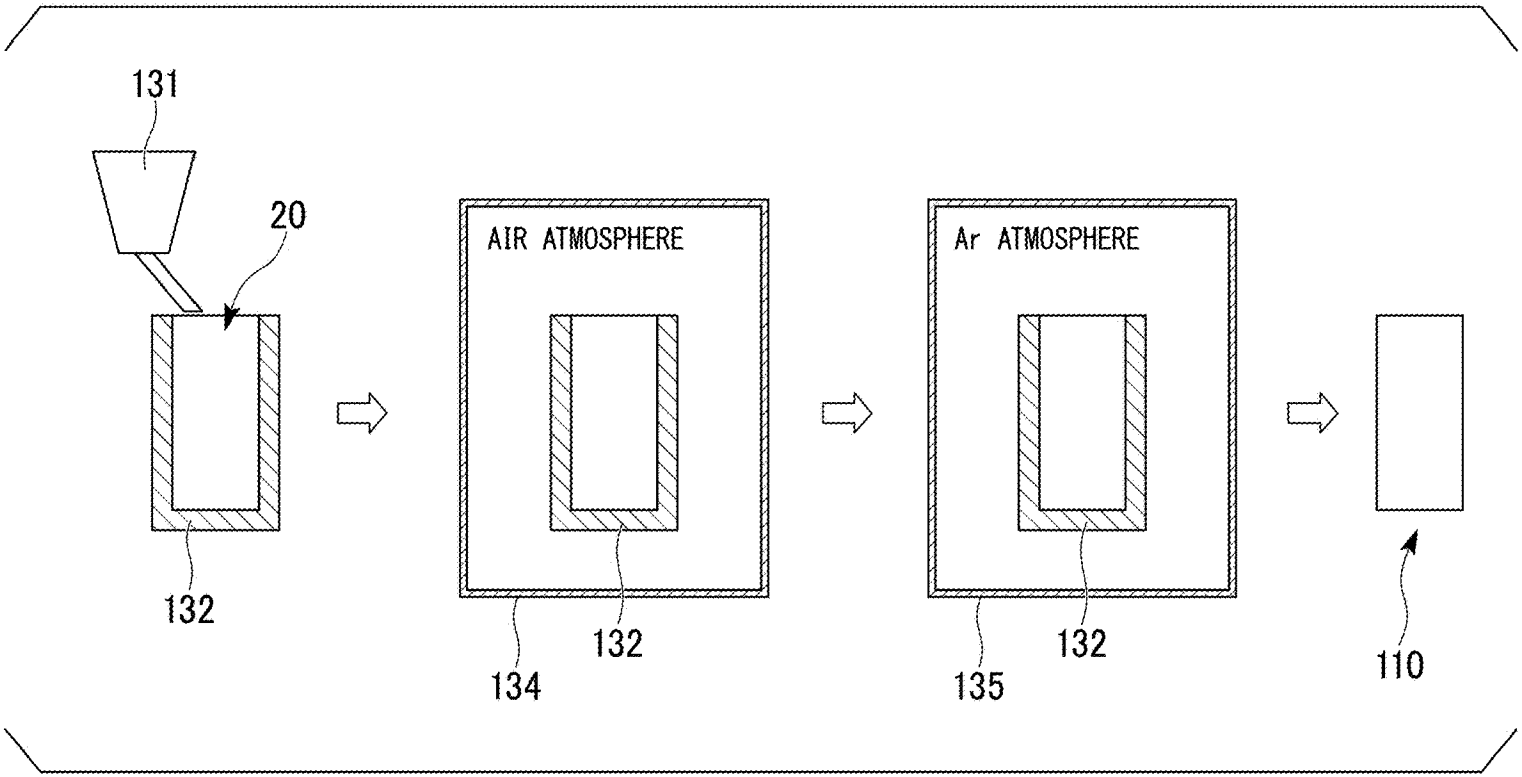
FIG. 7 is an explanatory diagram showing the production process for producing the porous aluminum sintered compact in a bulk-shape.

As shown in FIG. 7, the aluminum raw material for sintering 20 is spread to bulk fill (the raw material spreading step) on the carbon-made container 132 from the powder spreader 131 spreading the aluminum raw material for sintering 20. Then, the container 132 is inserted in the degreasing furnace 134; and the binder is removed by heating under air atmosphere (the binder removing step). Then, the container is inserted in the sintering furnace 135; and heated to and retained at 575° C. to 665° C. under an Ar atmosphere depending on the kind and the additive amount of the added eutectic element grains to obtain the bulk-shaped porous aluminum sintered compact 110.

In the present explanation, the bulk-shaped porous aluminum sintered compact 110 can be taken out from the carbon-made container 132 relatively easily, since a carbon-made container having excellent mold releasing characteristics is used as the carbon-made container 132; and the content is shrunk in the shrinkage rate about 1% during sintering.

In addition, it is explained that Ni, Mg, Cu and Si are used as examples of the eutectic element in the present embodiment. However, the present invention is not limited by this explanation; and one or more selected from Ag, Au, Ba, Be, Bi, Ca, Cd, Ce, Co, Cu, Fe, Ga, Gd, Ge, In, La, Li, Mg, Mn, Nd, Ni, Pd, Pt, Ru, Sb, Si, Sm, Sn, Sr, Te, Y, and Zn may be used as the eutectic element capable of eutectic reaction with Al.

Another method of producing the porous aluminum sintered compact is described below. In the present embodiment, the case in which any one of or both of the silicon powder and the silicon alloy powder are used as the eutectic element powder.

The aluminum fibers; and any one or both of the silicon powder and the silicon alloy powder, are mixed at room temperature. During mixing, a binder solution is sprayed on. As the binder, what is burned and decomposed during heating at 500° C. in the air is preferable. More specifically, using an acrylic resin or a cellulose-based polymer material is preferable. In addition, various solvents such as the water-based, alcohol-based, and organic-based solvents can be used as the solvent of the binder.

During mixing, the aluminum fibers 11*a* and the silicon powder are mixed by various mixing machine, such as an automatic mortar, a pan type rolling granulator, a shaker mixer, a pot mill, a high-speed mixer, a V-shaped mixer, and the like, while they are fluidized.

Next, by drying the mixture obtained by mixing, the silicon powder and the silicon alloy powder are dispersedly adhered on the outer surfaces of the aluminum fibers; and the aluminum raw material for sintering in the present embodiment is produced.

Next, during producing the porous aluminum sintered compact by using the aluminum raw material for sintering obtained as described above, the porous aluminum sintered compact in the long sheet shape of: 300 mm of width; 1-5 mm of thickness; and 20 m of length, is produced, for example, by using a continuous sintering apparatus or the like for example.

For example, the aluminum raw material for sintering is spread toward the upper surface of the carbon sheet from a raw material spreading apparatus; the aluminum raw material for sintering is stacked; and the aluminum raw material for sintering stacked on the carbon sheet is shaped into a sheet-shape. At this time, voids are formed between the aluminum fibers in the aluminum raw material for sintering without placing load.

At this time, for example, the aluminum fibers are stacked in such a way that the bulk density after filling becomes 50% of the true density of the aluminum fibers to maintain three-dimensional and isotropic voids between the aluminum fibers in stacking.

Next, the aluminum raw material for sintering, which is shaped into the sheet-shape on the carbon sheet, is inserted in the degreasing furnace; and the binder is removed by being heated at a predetermined temperature. At this time, the aluminum raw material for sintering is maintained at 350° C. to 500° C. for 0.5 to 5 minutes in the air atmosphere; and the binder in the aluminum raw material for sintering is removed. In the present embodiment, the binder is used only for adhering the silicon powder and the silicon alloy powder on the outer surfaces of the aluminum fibers. Thus, the content amount of the binder is extremely low compared to the viscous compositions; and the binder can be removed sufficiently in a short time.

Next, the aluminum raw material for sintering free of the binder is inserted in the sintering furnace with the carbon sheet and sintered by being heated at a predetermined temperature.

The sintering is performed by maintaining the aluminum raw material for sintering at 575° C. to 665° C. for 0.5 to 60 minutes in an inert gas atmosphere, for example. Depending on the content amount of silicon in the aluminum raw material for sintering, the optimum sintering temperature differs. However, in order to permit high-strength and uniform sintering, the sintering temperature is set to 575° C., which is the eutectic temperature of Al-12.6 mass % Si, or more. In addition, it is set to 665° C. or less in order to prevent rapid progression of sintering shrinkage due to combining of melts in the formed liquid phases. Preferably, the retention time is set to 1 to 20 minutes.

In the sintering, a part of the aluminum fibers in the aluminum raw material for sintering is melted. However, since the oxide films are formed on the surfaces of the aluminum fibers, the melted aluminum is held by the oxide film; and the shapes of the aluminum fibers are maintained.

Then, in the part where the silicon powder grains and the silicon alloy powder grains are adhered on the outer surfaces of the aluminum fibers, by Si, which is adhered on the surfaces of the aluminum fibers, reacting locally with the aluminum fibers, the melting point lowering effect is obtained locally in the vicinity of the adhering parts. As a result, the liquid phase is formed at an even lower temperature than the melting point of the pure aluminum fibers or the aluminum alloy fibers; and sintering is stimulated to improve strength compared to the case free of silicon addition.

EXAMPLES

Results of confirmatory experiments performed to confirm the technical effect of the present invention are explained below.

By the methods shown in the above-described embodiments and using the raw materials shown in Table 1, the aluminum raw materials for sintering were prepared. The aluminum fibers, the fiber diameter of which was 20 μm or more and 1000 μm or less; and the aluminum powder, the grain size of which was 5 μm or more and 500 μm or less, were used as the aluminum substrates By the production methods shown in the above-described embodiments and using these aluminum raw materials for sintering, the porous aluminum sintered compacts having the dimension of: 30 mm of width; 200 mm of length; and 5 mm of thickness, were produced. The temperature conditions in the step of sintering are shown in Table 1. Sintering was performed with the sintering temperature retention time of 15 minutes.

With respect to the obtained porous aluminum sintered compacts, the apparent porosity and the tensile strength were evaluated. The evaluation results are shown in Table 1. The evaluation methods are shown below.

[Apparent Porosity]

The mass m (g), the volume V ($cm^3$), and the true density d ($g/cm^3$) were measured in the obtained porous aluminum sintered compacts; and the apparent porosity was calculated by suing the formula shown below.

$$\text{Apparent Porosity}(\%)=(1-(m/(V\times d)))\times 100$$

The true density ($g/cm^3$) was measured by the water method with the precision balance.

[Tensile Strength]

The tensile strength of the obtained porous aluminum sintered compacts was measured by the pulling method.

In the present embodiment, it is explained that the aluminum substrates made of the pure aluminum is used. However, the present invention is not particularly limited by the description, and the aluminum substrates made of the standard aluminum alloy may be used.

For example, the aluminum substrates made of the A3003 alloy (Al-0.6 mass % Si-0.7 mass % Fe-0.1 mass % Cu-1.5 mass % Mn-0.1 mass % Zn alloy), the A5052 alloy (Al-0.25 mass % Si-0.40 mass % Fe-0.10 mass % Cu-0.10 mass % Mn-2.5 mass % Mg-0.2 mass % Cr-0.1 mass % Zn alloy) as defined in JIS, and the like can be suitably used.

In addition, the composition of the aluminum substrates is not limited to a specific single kind composition. It can be appropriately adjusted depending on the purpose, for example, like using the mixture of fibers made of the pure aluminum and the powder made of JIS A3003 alloy.

TABLE 1

| | | Aluminum substrate | | | Titanium powder | | | Eutectic element powder | | | | | |
|---|---|---|---|---|---|---|---|---|---|---|---|---|---|
| | | Material | Fiber (%) | Powder (%) | Material | Grain size (μm) | Content amount (mass %) | Material | Grain size (μm) | Content amount (mass %) | Sintering temperature (° C.) | Apparent porosity (%) | Tensile strength (N/mm$^2$) |
| Examples of the present invention | 1 | A1070 | 94.0 | — | Titanium hydride | 1.0 | 5.0 | Ni | 4.0 | 1.0 | 645 | 72.0 | 2.9 |
| | 2 | A1070 | 94.0 | — | Titanium hydride | 5.0 | 5.0 | Ni | 4.0 | 1.0 | 645 | 71.6 | 3.0 |
| | 3 | A1070 | 94.0 | — | Metal titanium | 30.0 | 5.0 | Ni | 4.0 | 1.0 | 645 | 70.5 | 2.8 |
| | 4 | A1070 | 94.0 | — | Metal titanium | 50.0 | 5.0 | Ni | 4.0 | 1.0 | 645 | 72.3 | 2.7 |
| | 5 | A1070 | 98.5 | — | Titanium hydride | 5.0 | 0.5 | Ni | 4.0 | 1.0 | 645 | 73.0 | 2.9 |
| | 6 | A1070 | 79.0 | — | Titanium hydride | 5.0 | 20.0 | Ni | 4.0 | 1.0 | 645 | 72.4 | 4.2 |
| | 7 | A1070 | 94.0 | — | Titanium hydride | 5.0 | 5.0 | Ni | 1.0 | 1.0 | 645 | 71.8 | 3.1 |
| | 8 | A1070 | 94.0 | — | Titanium hydride | 5.0 | 5.0 | Ni | 20.0 | 1.0 | 645 | 70.1 | 2.9 |
| | 9 | A1070 | 94.9 | — | Titanium hydride | 5.0 | 5.0 | Ni | 4.0 | 0.1 | 645 | 72.0 | 1.8 |
| | 10 | A1070 | 93.0 | — | Titanium hydride | 5.0 | 5.0 | Ni | 4.0 | 2.0 | 645 | 74.0 | 4.0 |
| | 11 | A1070 | 89.0 | 5.0 | Titanium hydride | 5.0 | 5.0 | Ni | 4.0 | 1.0 | 645 | 69.2 | 3.2 |
| | 12 | A1070 | 84.0 | 10.0 | Titanium hydride | 5.0 | 5.0 | Ni | 4.0 | 1.0 | 645 | 68.5 | 3.0 |
| | 13 | A1070 | 98.99 | — | Titanium hydride | 5.0 | 1.0 | Ni | 4.0 | 0.01 | 640 | 71.2 | 2.4 |
| | 14 | A1070 | 94.0 | — | Titanium hydride | 5.0 | 1.0 | Ni | 4.0 | 5.0 | 655 | 69.8 | 3.7 |
| | 15 | A1070 | 98.99 | — | Titanium hydride | 5.0 | 0.01 | Ni | 4.0 | 1.0 | 645 | 65.9 | 3.1 |
| | 16 | A1070 | 94.9 | — | Titanium hydride | 5.0 | 0.1 | Ni | 4.0 | 5.0 | 655 | 67.4 | 2.1 |
| | 17 | A3003 | 94.0 | — | Titanium hydride | 5.0 | 1.0 | Ni | 4.0 | 5.0 | 625 | 68.2 | 4.5 |
| | 18 | A5052 | 94.0 | — | Titanium hydride | 5.0 | 1.0 | Ni | 4.0 | 5.0 | 595 | 69.1 | 4.1 |
| | 19 | A1070 | 98.99 | — | Titanium hydride | 5.0 | 1.0 | Mg | 20.0 | 0.01 | 645 | 73.3 | 1.4 |
| | 20 | A1070 | 98.9 | — | Titanium hydride | 5.0 | 1.0 | Mg | 40.0 | 0.1 | 645 | 73.1 | 1.9 |
| | 21 | A1070 | 98.0 | — | Titanium hydride | 5.0 | 1.0 | Mg | 40.0 | 1.0 | 620 | 70.4 | 2.8 |
| | 22 | A1070 | 94.0 | — | Titanium hydride | 5.0 | 1.0 | Mg | 100.0 | 5.0 | 655 | 70.1 | 3.3 |
| | 23 | A1070 | 98.99 | — | Titanium hydride | 5.0 | 0.01 | Mg | 40.0 | 1.0 | 590 | 71.6 | 2.9 |
| | 24 | A1070 | 98.9 | — | Titanium hydride | 5.0 | 0.1 | Mg | 40.0 | 1.0 | 655 | 69.7 | 3.2 |
| | 25 | A1070 | 94.0 | — | Titanium hydride | 5.0 | 5.0 | Mg | 40.0 | 1.0 | 645 | 72.1 | 2.4 |
| | 26 | A1070 | 79.0 | — | Titanium hydride | 5.0 | 20.0 | Mg | 40.0 | 1.0 | 655 | 71.3 | 2.0 |
| | 27 | A3003 | 94.0 | — | Titanium hydride | 5.0 | 1.0 | Mg | 40.0 | 5.0 | 620 | 68.7 | 4.2 |

TABLE 2

| | | Aluminum substrate | | | Titanium powder | | | Eutectic element powder | | | | | |
|---|---|---|---|---|---|---|---|---|---|---|---|---|---|
| | | Material | Fiber (%) | Powder (%) | Material | Grain size (μm) | Content amount (mass %) | Material | Grain size (μm) | Content amount (mass %) | Sintering temperature (° C.) | Apparent porosity (%) | Tensile strength (N/mm$^2$) |
| Examples of the present invention | 28 | A5052 | 94.0 | — | Titanium hydride | 5.0 | 1.0 | Mg | 40.0 | 5.0 | 590 | 69.4 | 3.9 |
| | 29 | A1070 | 98.99 | — | Titanium hydride | 5.0 | 1.0 | Cu | 5.0 | 0.01 | 645 | 73.0 | 1.1 |
| | 30 | A1070 | 98.9 | — | Titanium hydride | 5.0 | 1.0 | Cu | 20.0 | 0.1 | 645 | 72.8 | 1.7 |

TABLE 2-continued

| | Aluminum substrate | | | Titanium powder | | | Eutectic element powder | | | | | |
|---|---|---|---|---|---|---|---|---|---|---|---|---|
| | Material | Fiber (%) | Powder (%) | Material | Grain size (μm) | Content amount (mass %) | Material | Grain size (μm) | Content amount (mass %) | Sintering temperature (° C.) | Apparent porosity (%) | Tensile strength (N/mm$^2$) |
| 31 | A1070 | 98.0 | — | Titanium hydride | 5.0 | 1.0 | Cu | 30.0 | 1.0 | 645 | 69.9 | 2.4 |
| 32 | A1070 | 94.0 | — | Titanium hydride | 5.0 | 1.0 | Cu | 30.0 | 5.0 | 650 | 70.6 | 3.5 |
| 33 | A1070 | 94.99 | — | Titanium hydride | 5.0 | 0.01 | Cu | 80.0 | 5.0 | 590 | 69.5 | 2.9 |
| 34 | A1070 | 98.9 | — | Titanium hydride | 5.0 | 0.1 | Cu | 30.0 | 1.0 | 645 | 67.5 | 2.6 |
| 35 | A1070 | 94.0 | — | Titanium hydride | 5.0 | 5.0 | Cu | 30.0 | 1.0 | 610 | 71.9 | 2.3 |
| 36 | A1070 | 79.0 | — | Titanium hydride | 5.0 | 20.0 | Cu | 30.0 | 1.0 | 655 | 71.0 | 2.2 |
| 37 | A3003 | 94.0 | — | Titanium hydride | 5.0 | 1.0 | Cu | 30.0 | 5.0 | 595 | 68.9 | 3.8 |
| 38 | A5052 | 94.0 | — | Titanium hydride | 5.0 | 1.0 | Cu | 30.0 | 5.0 | 575 | 69.2 | 4.3 |
| 39 | A1070 | 98.99 | — | Titanium hydride | 5.0 | 1.0 | Si | 5.0 | 0.01 | 655 | 72.3 | 1.5 |
| 40 | A1070 | 98.9 | — | Titanium hydride | 5.0 | 1.0 | Si | 10.0 | 0.1 | 610 | 71.6 | 2.1 |
| 41 | A1070 | 98.0 | — | Titanium hydride | 5.0 | 1.0 | Si | 80.0 | 1.0 | 645 | 70.3 | 2.9 |
| 42 | A1070 | 94.0 | — | Titanium hydride | 5.0 | 1.0 | Si | 80.0 | 5.0 | 650 | 69.7 | 3.8 |
| 43 | A1070 | 89.0 | — | Titanium hydride | 5.0 | 1.0 | Si | 100.0 | 10.0 | 590 | 70.5 | 2.6 |
| 44 | A1070 | 84.0 | — | Titanium hydride | 5.0 | 1.0 | Si | 170.0 | 15.0 | 575 | 71.2 | 2.7 |
| 45 | A1070 | 98.99 | — | Titanium hydride | 5.0 | 0.01 | Si | 80.0 | 1.0 | 645 | 69.8 | 2.3 |
| 46 | A1070 | 98.9 | — | Titanium hydride | 5.0 | 0.1 | Si | 80.0 | 1.0 | 645 | 70.6 | 2.5 |
| 47 | A1070 | 94.0 | — | Titanium hydride | 5.0 | 5.0 | Si | 80.0 | 1.0 | 645 | 71.2 | 2.1 |
| 48 | A1070 | 79.0 | — | Titanium hydride | 5.0 | 20.0 | Si | 80.0 | 1.0 | 645 | 72.4 | 1.8 |
| 49 | A3003 | 94.0 | — | Titanium hydride | 5.0 | 1.0 | Si | 80.0 | 5.0 | 610 | 68.0 | 4.7 |
| 50 | A5052 | 94.0 | — | Titanium hydride | 5.0 | 1.0 | Si | 80.0 | 5.0 | 580 | 68.8 | 4.2 |
| Comparative Example 1 | A1070 | 95.0 | — | Titanium hydride | 5.0 | 5.0 | — | — | — | 662 | 70.2 | 0.5 |
| Comparative Example 2 | A1070 | 100.0 | — | — | — | — | — | — | — | 665 | 75.3 | 0.1 |

In Tables 1 and 2, the apparent porosities and the tensile strength, when sintering was performed in the condition where the metal titanium powder or the titanium hydride; and the eutectic element were added to the aluminum substrates, are shown.

In Examples 1 to 50 of the present invention, in which the aluminum raw materials including the eutectic element powders were used, it was confirmed that strength was improved sufficiently even though they had apparent porosities equivalent to Comparative Examples 1 and 2, in which the aluminum raw materials free of the eutectic element powder were used.

Based on the observation, it was confirmed that the high-quality porous aluminum sintered compact having high porosity and sufficient strength could be provided according to the present invention.

REFERENCE SIGNS LIST

10, 110: Porous aluminum sintered compact
11: Aluminum substrate
11*a*: Aluminum fiber
11*b*: Aluminum powder
12: Pillar-shaped protrusion
15: Junction
16: Ti—Al compound
17: Eutectic element compound
20: Aluminum raw material for sintering
22: Titanium powder grain (Titanium powder)
23: Eutectic element powder grain (Eutectic element powder)

What is claimed is:

1. A porous aluminum sintered compact comprising a plurality of aluminum substrates sintered to each other, wherein the aluminum substrates are made of aluminum fibers or both of aluminum fibers and an aluminum powder, a fiber diameter of the aluminum fiber is in a range of 50 μm or more and 1000 μm or less, a junction in which the plurality of aluminum substrates are bonded to each other includes a Ti—Al compound and a eutectic element compound including a eutectic element capable of eutectic reaction with Al, and a plurality of pillar-shaped protrusions projecting toward an outside are formed on outer surfaces of the aluminum substrates, and the pillar-shaped protrusions include the junction.

2. The porous aluminum sintered compact according to claim 1, wherein a porosity of the porous aluminum sintered compact is in a range of 30% or more and 90% or less.

3. The porous aluminum sintered compact according to claim 2, wherein the porosity of the porous aluminum sintered compact is in a range of 65.9% or more and 90% or less.

4. A method of producing a porous aluminum sintered compact including a plurality of aluminum substrates sintered to each other, the method comprising the steps of:

forming an aluminum raw material for sintering by adhering a titanium powder, which is made of any one of or both of a titanium metal powder and a titanium hydride powder, and a eutectic element powder made of a eutectic element capable of eutectic reaction with Al on outer surfaces of the aluminum substrates;

spreading the aluminum raw material for sintering on a holder; and sintering the aluminum raw material held on the holder by heating, wherein the porous aluminum sintered compact according to claim 1 is produced, the aluminum substrates are made of aluminum fibers or both of aluminum fibers and an aluminum powder, a fiber diameter of the aluminum fiber is in a range of 50 μm or more and 1000 μm or less, and the plurality of the aluminum substrates are bonded through a junction including a Ti—Al compound and a eutectic element compound including the eutectic element capable of eutectic reaction with Al.

5. The method of producing a porous aluminum sintered compact according to claim 4, wherein a nickel powder is used as the eutectic element powder in the step of forming an aluminum raw material for sintering;

a content amount of the titanium powder in the aluminum raw material for sintering is set in a range of 0.01 mass % or more and 20 mass % or less; and a content amount of the nickel powder in the aluminum raw material for sintering is set in a range of 0.01 mass % or more and 5 mass % or less.

6. The method of producing a porous aluminum sintered compact according to claim 4, wherein a magnesium powder is used as the eutectic element powder in the step of forming an aluminum raw material for sintering;

a content amount of the titanium powder in the aluminum raw material for sintering is set in a range of 0.01 mass % or more and 20 mass % or less; and a content amount of the magnesium powder in the aluminum raw material for sintering is set in a range of 0.01 mass % or more and 5 mass % or less.

7. The method of producing a porous aluminum sintered compact according to claim 4, wherein a copper powder is used as the eutectic element powder in the step of forming an aluminum raw material for sintering;

a content amount of the titanium powder in the aluminum raw material for sintering is set in a range of 0.01 mass % or more and 20 mass % or less; and a content amount of the copper powder in the aluminum raw material for sintering is set in a range of 0.01 mass % or more and 5 mass % or less.

8. The method of producing a porous aluminum sintered compact according to claim 4, wherein a silicon powder is used as the eutectic element powder in the step of forming an aluminum raw material for sintering;

a content amount of the titanium powder in the aluminum raw material for sintering is set in a range of 0.01 mass % or more and 20 mass % or less; and a content amount of the silicon powder in the aluminum raw material for sintering is set in a range of 0.01 mass % or more and 15 mass % or less.

9. The method of producing a porous aluminum sintered compact according to claim 4, wherein the step of forming an aluminum raw material for sintering comprises the steps of:

mixing the aluminum substrates; and the titanium powder and the eutectic element powder, in a presence of a binder; and drying a mixture obtained in the step of mixing.

* * * * *